United States Patent [19]

Layher

[11] 4,331,218

[45] May 25, 1982

[54] SCAFFOLD PLANK

[76] Inventor: Eberhard Layher, Blankenhornstrasse 17, D-7129 Güglingen-Eibensbach (Württemberg), Fed. Rep. of Germany

[21] Appl. No.: 131,869

[22] Filed: Mar. 19, 1980

Related U.S. Application Data

[63] Continuation-in-part of Ser. No. 961,244, Nov. 16, 1978, abandoned.

[30] Foreign Application Priority Data

Dec. 6, 1977 [DE] Fed. Rep. of Germany ..... 2754226
Apr. 26, 1979 [DE] Fed. Rep. of Germany ..... 2916826

[51] Int. Cl.[3] ..... E04G 5/08
[52] U.S. Cl. ..... 182/222; 182/119; 182/179
[58] Field of Search ..... 182/222, 223, 178, 179, 182/119, 118; 14/69.5, 71.1

[56] References Cited

U.S. PATENT DOCUMENTS

| | | | |
|---|---|---|---|
| 1,415,554 | 5/1922 | Hatch | 182/222 |
| 2,485,165 | 10/1949 | Pollman | 182/223 |
| 3,085,651 | 4/1963 | Rich | 182/222 |
| 3,150,617 | 9/1964 | Phillips | 5/296 |
| 3,943,589 | 3/1976 | Pedersen | 182/222 |

FOREIGN PATENT DOCUMENTS

| | | | |
|---|---|---|---|
| 586335 | 3/1977 | Switzerland | 182/222 |
| 1148927 | 4/1969 | United Kingdom | 182/222 |
| 1245942 | 9/1971 | United Kingdom | 182/222 |

*Primary Examiner*—Reinaldo P. Machado
*Attorney, Agent, or Firm*—Michael J. Striker

[57] ABSTRACT

A scaffold plank has a horizontal metal walkway provided with a plurality of perforations with selectively upwardly and downwardly extending collars, two side flange members each extending along one side edge of the walkway and formed by a side portion of the latter, and two end profiled members each extending beneath the walkway along one end edge of the latter and connected with the walkway and the side flange members. Each end profiled member is provided with an element for suspending the plank.

8 Claims, 10 Drawing Figures

SCAFFOLD PLANK

CROSS-REFERENCE TO RELATED APPLICATION

This application is a continuation-in-part of the copending application Ser. No. 961,244, filed Nov. 16, 1978 and now abandoned.

BACKGROUND OF THE INVENTION

The present invention relates to a plank for scaffolds, working platforms, cantilevers, podia and similar structures. More particularly, the present invention relates to a plank which has a metallic walkway provided with a plurality of uniformly distributed perforations including some perforations bounded by downwardly extending collars and other perforations bounded by upwardly extending collars.

It has been recognized that such planks will provide for sufficient bending resistance in certain loading conditions. In this case, insignificant deformation of the plank takes place which results in lifting of a sheet metal catch provided on the side flange of the plank. Thereby rocking movement of the plank takes place in this condition.

SUMMARY OF THE INVENTION

Accordingly, it is an object of the present invention to provide a plank which avoids the disadvantages of the prior art.

More particularly, it is an object of the present invention to provide a plank in which buckling of the plank or lifting of its catch are eliminated.

In keeping with these objects and with others which will become apparent hereinafter, one feature of the present invention resides, briefly stated, in a scaffold plank having a metal walkway and two side flanges, in which two profiled members are provided, each located beneath the metal walkway, extending along the respective end edge of the same over the entire width, connected with the walkway and the side flanges, and provided with fixedly mounted suspending means.

When the scaffold plank is constructed in accordance with the present invention, it is formed as a closed rigid frame which is composed of the horizontal metal walkway, two side flange members which are of one piece with the walkway, and two end profiled members which are connected with the walkway and the side flange members. A further advantage of this construction is that the suspending means can be manufactured so that it is stable and has a wide supporting face, and at the same time cannot lift inasmuch as it is fixedly connected with the end profiled members.

The above-mentioned end profiled members can be constructed in different ways. For example, when the walkway is constituted of sheet steel, each end profiled member may be formed as a U-shaped profiled member of steel, whose legs extend inwardly of the scaffold plank. A web connecting the legs of such a U-shaped profiled member has an outer surface on which wide catches produced by drawing of steel sheet are mounted, for example by welding. On the other hand, when the walkway is constituted of aluminum sheet, the suspending means may be formed as an aluminum profiled member produced by extrusion process and extending over the entire width of the walkway.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 8*a*—8*c* are views schematically showing portions of two scaffold planks connected with one another.

DESCRIPTION OF PREFERRED EMBODIMENTS

Figure 1:
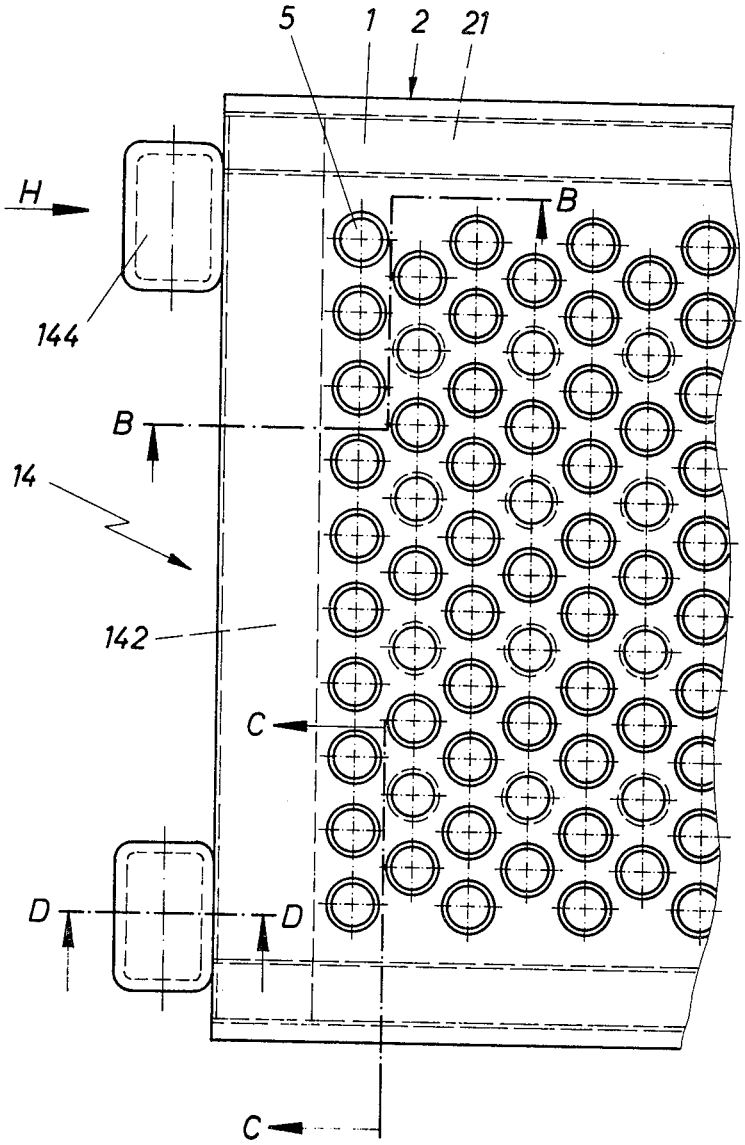
FIG. 1 is a plan view showing an end of a scaffold plank in accordance with the present invention.

A scaffold plank in accordance with the present invention has a walkway which is identified by reference numeral 1 and is constituted of a perforated metal sheet forming a walking surface. The walkway has a plurality of substantially uniformly distributed perforations of which some perforations are bounded by upwardly extending collars and other perforations are bounded by downwardly extending collars.

Figure 2:
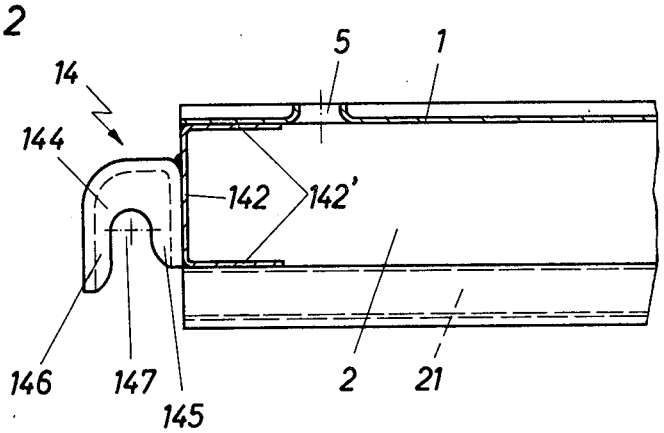
FIG. 2 is a view showing a vertical section of the end of the scaffold plank, taken along the line B—B in FIG. 1.

The walkway 1 has two end edges of which only the left edge is shown in FIG. 1. Two end profiled members are provided in the regions of the end edges of the walkway 1 of which only one end profiled member is shown in FIG. 1 and identified by reference numeral 14. The end profiled member 14 is formed by a U-shaped member 142 having two legs 142' (see FIG. 2) connected with one another by a web. The legs 142' of the U-shaped member 142 extends into the interior of the scaffold plank. The web of the U-shaped member 142 carries two catches 144. This can be seen from FIGS. 1 and 2. Because of the trajectory of the section B—B only the aperture with the upwardly extending collar can be seen in FIG. 2.

The metal sheet 1 forming the walkway has two side ends and is provided with two side flanges 2. Each side flange is formed by bending of the side region of the sheet 1 downwardly and has a further bent portion 21 serving for reinforcing purposes. Each member 142 forms, together with the sheet 1 and the side flanges 2 with the reinforcing portions 21 a rigid frame. This rigid frame prevents bending of the scaffold plank.

The web of each of the U-shaped profiled members 142 has an outer face on which the catches 144 are mounted. Each of the catches 144 is composed of a steel sheet 148 which is manufactured by deep drawing and respectively deformed. The steel sheet 148 is so deformed that its both sides faces 144 are provided with recesses 147 each limited by a respective one of legs 145 and 146. The catches 144 are fixedly mounted on the U-shaped profiled member 142 by welding.

Each catch 144 is so formed that its leg 146 extends downwardly further than its other leg 145 abutting against the U-shaped profiled member 142. Each catch 144 has a lower edge 146' of a front end face, which extends by a certain distance below a lower edge 145' of an outer wall of the leg 145.

Figure 3:
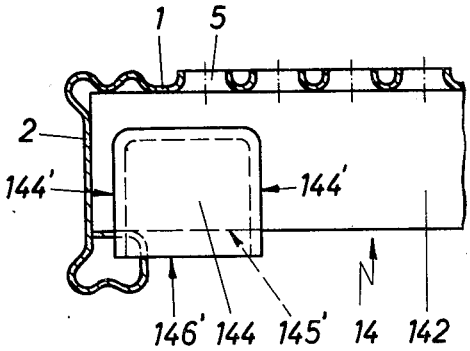
FIG. 3 is a front view of a scaffold plank of FIG. 1, in the direction of the arrow H in FIG. 1.
Figure 4:
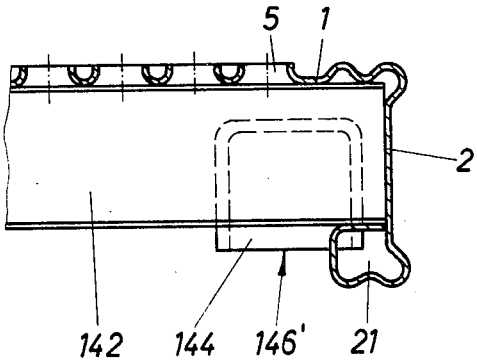
FIG. 4 is a view showing a front side of the same scaffold plank corresponding to the vertical section C—C in FIG. 1 in the direction of the arrow, but seen from the interior of the scaffold plank.
Figure 5:
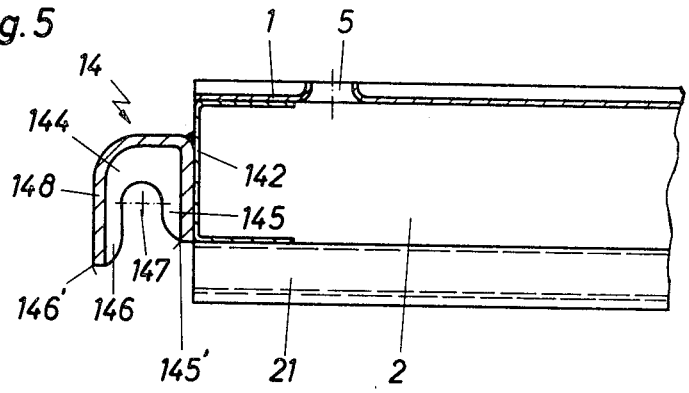
FIG. 5 is a view showing a section of a catch provided on the scaffold plank, taken along the line D—D in FIG. 1.

FIGS. 3 and 4 show the end profiled member 14 in direction of the arrow H in FIG. 1, and from inside of the scaffold plank, respectively.

The walkway of the scaffold plank shown in FIGS. 1–5 is constituted of steel sheet, and thereby the end profiled member is formed as a steel profiled member. When the walkway of the scaffold plank is constituted of aluminum sheet, there is a possibility to manufacture the catches for suspending the scaffold plank of aluminum with the utilization of an extrusion process and to weld such catches to the walkway of aluminum sheet.

In accordance with a further embodiment of the invention, the walkway is provided at its both end sides with an end profiled member of aluminum which is manufactured by an extrusion process. Such an end profiled member may extend over the entire width of the walkway, and the suspending means or catches are so formed that they can serve for bridging a distance or gap between two successively arranged scaffold planks.

In this construction, instead of the U-shaped profiled member, a four-cornered tubular member having a longitudinal inner chamber may be provided. This tubular member may have a hook-like U-shaped portion forming a further longitudinal chamber and having an upper wall which forms an extension of a walking surface of the walkway. This upper wall may have a width extending up to the center of the gap between two successively arranged scaffold planks.

Figure 6:
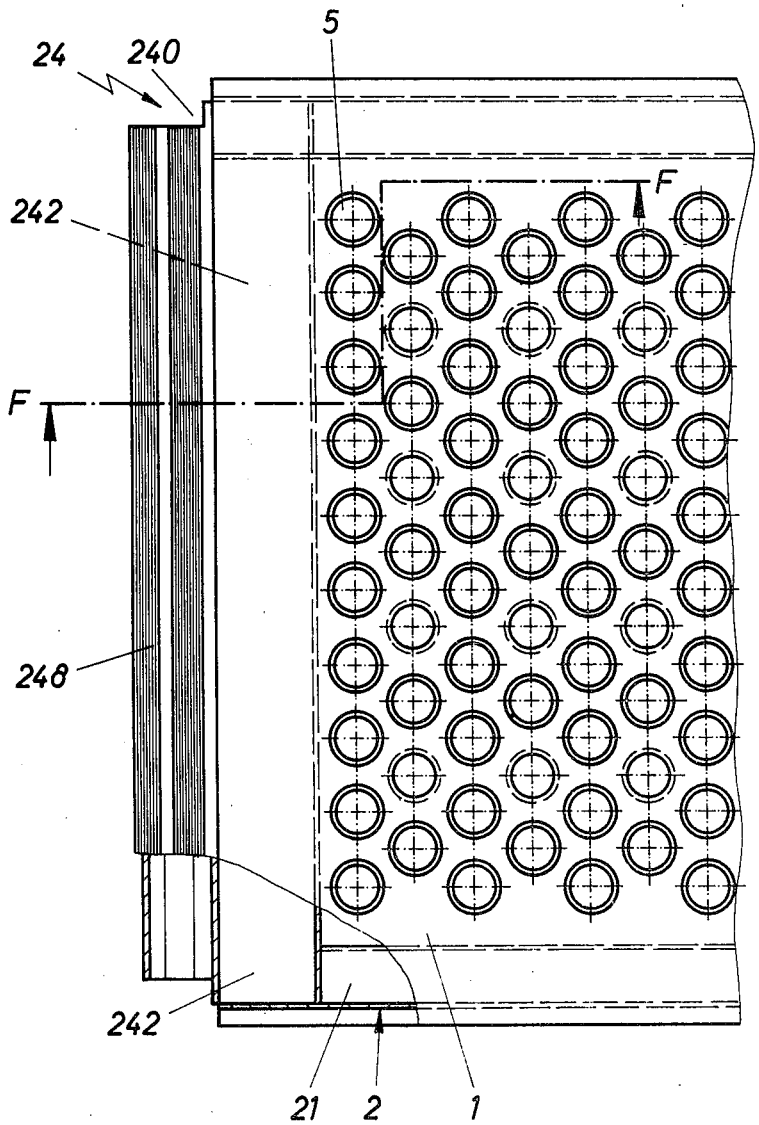
FIG. 6 is a plan view showing an end of the scaffold plank with an aluminum walkway and with end profiled members in accordance with another embodiment of the present invention.

FIG. 6 shows one end of such a scaffold plank in plan view, wherein the metal sheet forming the walkway is removed at its one corner. An end profiled member 24 is formed as a through-going web extending over the entire width of the walkway 1. The part of the end profiled member 24 extending in the region of the above-mentioned corner of the walkway is partially sectioned.

Figure 7:
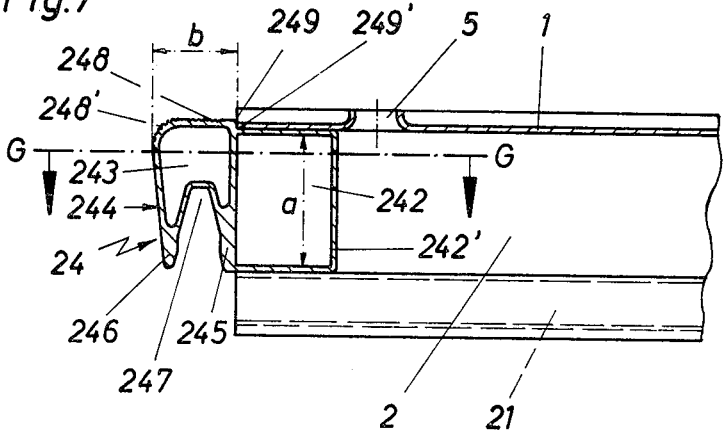
FIG. 7 is a view showing a vertical section through the end of the scaffold plank of FIG. 6, taken along the line F—F.

FIG. 7 shows a vertical section of this scaffold plate taken along the line A—A in FIG. 1 wherein one of the perforations 5 with upwardly extending collars can be seen. The other perforations with downwardly extending collars are not shown.

The end profiled member 24 is formed as an extrusion produced profiled member which includes a boxshaped longitudinally extending hollow portion 242. The hollow portion 242 has a shape of a four-cornered tube and its upper and lower walls are spaced from one another by a distance a which substantially corresponds to the distance between the lower face of the sheet 1 forming the walkway and the upper face of the reinforcing portion 21 of the side flanges 2. The box-shaped hollow portion 242 engages in the interior of the scaffold plank from its end side and is fixedly connected with the walkway 1 by welding.

The suspending means is formed on a wall of the hollow portion 242, the wall facing outwardly of the scaffold plank. The suspending means is formed here as a hook-like profiled member 244 which has two legs 245 and 246 together forming a longitudinal groove 247. The longitudinal groove 247 is open downwardly and serves for suspending of the end profiled member 24 on an element of a scaffold, for example on a supporting edge of a U-shaped profiled transverse beam. The leg 245 simultaneously forms the outer wall of the hollow portion 242.

A further longitudinal hollow portion 243 is formed above the longitudinal groove 247. The longitudinal hollow portion 243 serves for bridging a distance between two consecutively arranged scaffold planks so as to eliminate any interruption between the latter. The hollow portion 243 has an upper wall with an upper surface 248 which is provided with a plurality of projections, that is, for example by knurling. This prevents slippage of a person on the scaffold plank. The plank of this upper wall is slightly rounded and also knurled as identified by reference numeral 248'.

The hollow portion 242 over the walking face formed by the same, has a width b which substantially corresponds to one-half of the distance between the end faces of the walkways of the successively arranged scaffold planks.

The upper wall of the hollow portion 243 has an inner edge against which the metal sheet of the walkway 1 abuts. This edge is provided with a projection 249 which extends upwardly beyond the walkway 1 by a small distance and is undercut at its surface facing toward the walkway. Thereby, the metal sheet of the walkway engages in a groove 249'.

As mentioned above, the end profiled member 24 extends over the entire width of the walkway. In order to fix the plank on the transverse beam of the scaffold, the hollow portion 243 and the legs 245 and 246 are so cut out that the outer wall of the box-shaped hollow portion 242 remains uncut. Thereby, a recess 240 is produced which makes possible orderly suspension of the scaffold plank on the elements of the scaffold. The respective part of the projection 248 can also be removed.

It is to be understood that it is also possible to subdivide the end profiled member 24 into shorter sections and mount several, for example 4, individual hooks spaced from one another over the length of the front side. However, in this case, the walking surfaces between two adjacent hooks will be interrupted. It is also possible to dispense with the inner wall 242' of the box-shaped portion 242. In this case, a U-shaped profiled portion will be utilized instead of the box-shaped portion with the similar connection to the metal sheet of the walkway.

The perforations in the walkway are so formed that the perforations bounded by the upwardly extending collars have a diameter which is identical to the diameter of the perforations bounded by the downwardly extending collars. This substantially facilitates the production of the perforations. Both groups of perforations may be produced by a tool, such as a punch, having one diameter for all perforations, regardless of the direction in which the collars extend.

FIGS. **8*a*–8*c* show two scaffold planks connected with one another in accordance with the present invention. FIG. 8*a* is a side view, whereas FIG. 8*b* is a plan view of two connected scaffold planks each formed as shown in FIG. 1, and FIG. 8*c*** is a plan view of two connected scaffold planks each formed as shown in FIG. 6.

It will be understood that each of the elements described above, or two or more together, may also find a useful application in other types of constructions differing from the types described above.

While the invention has been illustrated and described as embodied in a scaffold plank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A scaffold plank, comprising a horizontal metal walkway having two end edges spaced from one another in a first direction, and two side edges spaced from one another in a second direction which is transverse to said first direction, said walkway having a plurality of regularly distributed perforations including some perforations bounded by upwardly extending collars and other perforations bounded by downwardly extending collars, said perforations having identical diameters, and the number of perforations bounded by upwardly extending collars exceeding the number of perforations bounded by downwardly extending collars; two side flange members each extending along a respective one of said side edges of said metal walkway in said first direction and formed by a side portion of the latter; two end profiled members each located beneath said metal walkway and extending along a respective one of said end edges over the entire width thereof in said second direction, each of said profiled members being formed as a four-cornered tubular member and connected with said metal walkway and with said side flange members; and means for suspending the plank, fixedly mounted on each of said end profiled members, said suspending means being arranged so that when two such scaffold planks are located laterally adjacent to one another, the suspending means of the respective end profiled members of the two scaffold planks laterally abut against one another over their entire length.

2. A scaffold plank as defined in claim 1, wherein each of said tubular members is constituted of an extrusion-produced aluminum member.

3. A scaffold plank as defined in claim 2, wherein said suspending means includes a hook-shaped member provided on a respective one of said tubular members over the entire length thereof in said second direction and each arranged to laterally abut against the respective hook-shaped member of an adjacently located another such scaffold plank.

4. A scaffold plank as defined in claim 1, wherein said flange members extend downwardly of said walkway so as to form, together with the latter, an inner chamber, each of said four-cornered tubular members extending into said chamber.

5. A scaffold plank, comprising a horizontal metal walkway having two end edges spaced from one another in a first direction, and two side edges spaced from one another in a second direction which is transverse to said first direction, said walkway having a plurality of regulary distributed perforations including some perforations bounded by upwardly extending collars and other perforations bounded by downwardly extending collars; two side flange members each extending along a respective one of said side edges of said metal walkway in said first direction and formed by a side portion of the latter; two end profiled members formed as four-cornered tubular members each located beneath said metal walkway and extending along a respective one of said end edges over the entire width thereof in said second direction, each of said profiled members being connected with said metal walkway and with said side flange members; and means for suspending the plank, fixedly mounted on each of said end profiled members, said suspending means including a hook-shaped member provided on a respective one of said tubular members and extending over the entire length thereof in said second direction, each of said hook-shaped members being hollow and having a lower hook-shaped wall and an upper wall which together bound an inner hollow extending over the entire length of said hook-shaped member in said second direction, said upper wall having an upper surface forming an extension of an upper surface of said walkway in said first direction.

6. A scaffold plank as defined in claim 5, wherein said upper wall has a width in said first direction, which is equal to substantially one half of a distance between the walkways of two such consecutively arranged scaffold planks.

7. A scaffold plank as defined in claim 5, wherein said upper surface of said upper wall of each of said hook-shaped members has a plurality of projections.

8. A scaffold plank, comprising a horizontal metal walkway having two end edges spaced from one another in a first direction, and two side edges spaced from one another in a second direction which is transverse to said first direction, said walkway having a plurality of regularly distributed perforations including some perforations bounded by upwardly extending collars and other perforations bounded by downwardly extending collars, said perforations having identical diameters, and the number of perforations bounded by upwardly extending collars exceeding the number of perforations bounded by downwardly extending collars; two side flange members each extending along a respective one of said side edges of said metal walkway in said first direction and formed by a side portion of the latter; two end profiled members each located beneath said metal walkway and extending along a respective one of said end edges over the entire width thereof in said second direction, each of said profiled members being formed as a four-cornered tubular member and connected with said metal walkway and with said side flange members; and means for suspending the plank, fixedly mounted on each of said end profiled members.

* * * * *